United States Patent [19]

Schmidt

[11] Patent Number: 4,954,671

[45] Date of Patent: Sep. 4, 1990

[54] CONNECTIBLE SWITCHING DEVICE

[75] Inventor: Hans Schmidt, Regenstauf, Fed. Rep. of Germany

[73] Assignee: Siemens Aktiengesellschaft, Berlin & Munich, Fed. Rep. of Germany

[21] Appl. No.: 323,347

[22] Filed: Mar. 14, 1989

[30] Foreign Application Priority Data

Mar. 14, 1988 [DE] Fed. Rep. of Germany ..... 3808472

[51] Int. Cl.[5] ..... H01H 9/20; H01H 3/58

[52] U.S. Cl. ..... 200/50 C; 200/DIG. 6

[58] Field of Search ..... 200/50 C, DIG. 6; 335/8–10; 337/43–50

[56] References Cited

U.S. PATENT DOCUMENTS

| | | | |
|---|---|---|---|
| 2,824,191 | 2/1958 | Christensen | 337/50 |
| 3,464,045 | 8/1969 | Klein | 337/35 |
| 4,385,214 | 5/1983 | Sullivan | 200/50 C X |

FOREIGN PATENT DOCUMENTS

| | | |
|---|---|---|
| 1044937 | 11/1958 | Fed. Rep. of Germany . |
| 1286620 | 1/1969 | Fed. Rep. of Germany . |
| 2540745 | 2/1977 | Fed. Rep. of Germany . |

*Primary Examiner*—J. R. Scott

*Attorney, Agent, or Firm*—Kenyon & Kenyon

[57] ABSTRACT

A switching device in a system of switching devices, which can be coupled to mountable switching, auxiliary switching, or signal devices. In the case of a cylindrical, manually operated part, disposed in the housing, having a selector, a coupling element pair comprising a jaw-shaped coupling element and a cone-shaped coupling element are provided on the cylindrical part in the direction of the switching axis on a mounting side, the pair of coupling elements being movable behind a housing slot, and being forced in engagement connection with each other and arranged in a housing slot on the surface of a device to be attached.

2 Claims, 2 Drawing Sheets

CONNECTIBLE SWITCHING DEVICE

BACKGROUND OF THE INVENTION

The present invention relates to a switching device in a system of switching devices, which can be coupled to mountable switching, auxiliary switching, or signal switching devices.

These types of switching devices are available on the market in many different model types. In a known switching device (German Pat. No. 25 40 745), a multipole switch is constructed from a monopole circuit-breaker, whereby the actuating handles are interconnected with a busbar-type bridge. To allow tolerances to be equalized during assembly, the handles have central recesses on their front sides, into which knobs engage with clearance in the longitudinal direction of the bridge. There are occasions, when one would like to do without these types of specially adapted bridge elements used specifically in the assembly.

SUMMARY OF THE INVENTION

It is an object of the present invention to provide a system of switching devices, whereby the switching devices are coupled without necessitating specifically prepared coupling elements.

The above and other objects of the invention are achieved by a switching device in a system of switching devices, which can be coupled to mountable switching, auxiliary switching or signal devices, comprising a housing, a cylindrical, manually operated part disposed in the housing having a selector, a coupling element consisting of a pair, according to function, of a jaw-shaped and a cone-shaped coupling element constructed on the cylindrical part in the direction of the switching axis on a mounting side, with which the other coupling element of the function pair can be forced into engagement connection, wherein the jaw-like coupling element has a jaw tooth in engagement depth only for one coupling direction for a shallower penetration of a cone-like coupling element.

A jaw-shaped coupling element can be arranged on the cylindrical part in the direction of the switching axis on a mounting side of the housing, for example, and works together with the cone-shaped coupling element in a housing slot on a surface of the housing, which engages from a device to be attached into the jaw-shaped coupling element on the mounting side of a target device.

According to a further embodiment, whereby the penetration of a cone-shaped coupling element is not as deep, the jaw-shaped coupling element is designed only for one coupling direction with a jaw tooth or a jaw flank of the jaw-shaped coupling element in engagement depth. Thus, with a long cone-shaped coupling element, a strong coupling of the manually operated parts can be attained for all the movements of a manually operated part, resulting from automatic tripping action, as well as hand operation. This type of coupling is desired, for example, between a circuit-breaker and an auxiliary switch to be attached. If the cone-shaped coupling element of the switching device to be attached is designed just short enough, so that the jaw-shaped coupling element of a circuit-breaker, in the case of a provided second, shorter penetration depth, forms a jaw tooth only in the switch-on direction, then the switching device to be attached remains intact, when switching off manually. Thereby, one can easily fulfill the conditions that are required between signal circuit controllers and circuit-breakers of the error-signal circuit controller type.

Such a signal circuit controller can only be switched on by the selector of the circuit-breaker, but can no longer be switched off by it. The signal circuit controller can only emit a signal, if the circuit-breaker has responded in automatic tripping action. In circuit-breakers of a monopole or multipole construction, a separate tripping coupling assures, in normal operation, that the signal circuit controller is switched off, only when there is an overload condition, whether it be an overcurrent or a short circuit of the circuit protected by the circuit-breaker.

BRIEF DESCRIPTION OF THE DRAWINGS

The invention will be described in greater detail in the following detailed description with reference to the drawings, in which.

DETAILED DESCRIPTION

Figure 1:
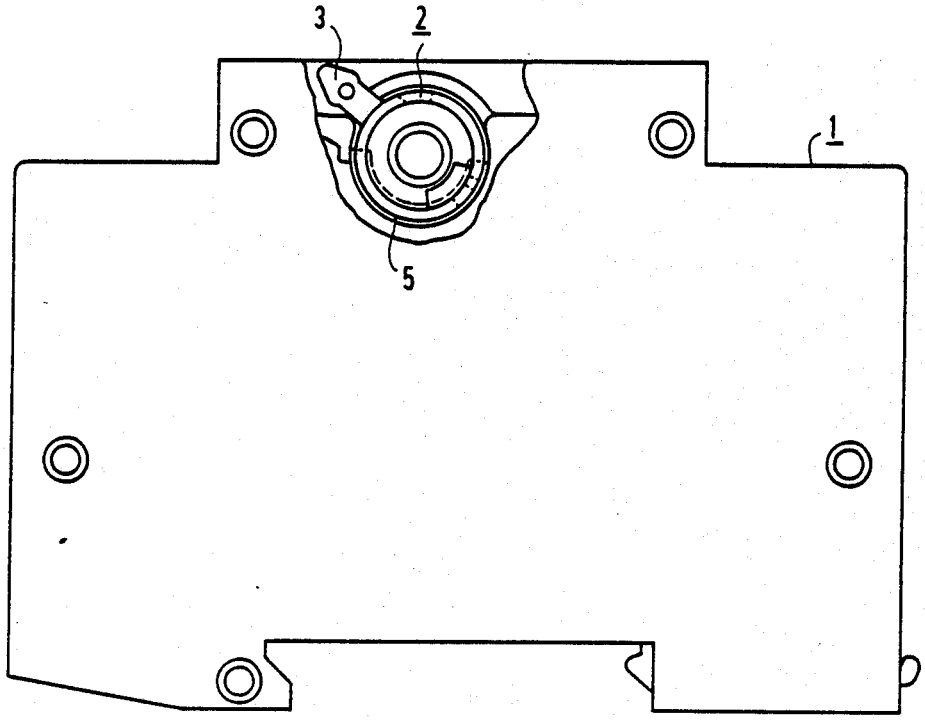
FIG. 1 shows a connectible switching device, designed as a circuit-breaker, reproduced in its longitudinal direction, and with a part thereof shown in a cutaway view.
Figure 4:
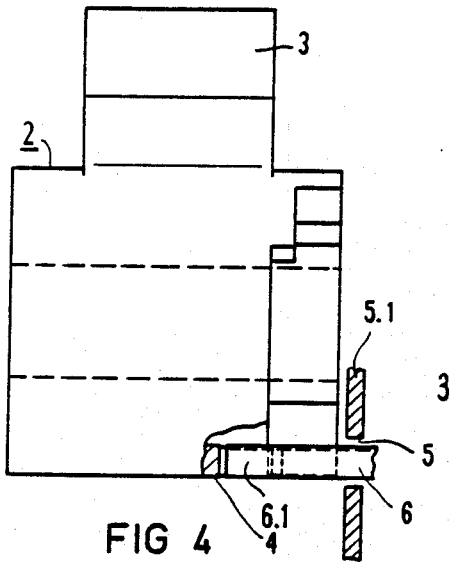
FIG. 4 shows a view of the representation of FIG. 3 rotated by 90°.
Figure 2:
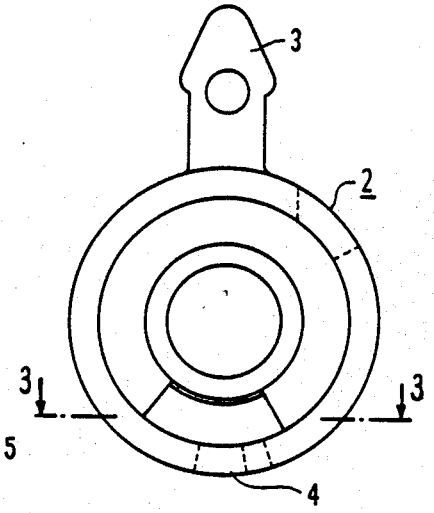
FIG. 2 shows a manually operated part of the switching device of FIG. 1 reproduced in larger scale.
Figure 3:
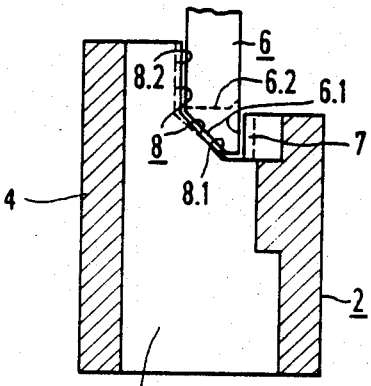
FIG. 3 shows a sectional view along line 3—3 of FIG. 2, together with a cone-shaped coupling element of an auxiliary switch to be attached.

The switching device 1 of FIG. 1 has a cylindrical, manually operated part 2 with a selector 3, which protrudes from a housing 5.1. As shown in FIG. 3, a jaw-shaped coupling element 4 is arranged on the cylindrical part 2 in the direction of the switching axis on a mounting side, behind the drawing plane. The coupling element 4 is movable with its mounting behind a housing slot 5. A cone-shaped coupling element 6 of FIG. 3 is arranged in the housing slot on a surface. In one embodiment, the cone-shaped coupling element 6 engages deeply with the jaw-shaped coupling element 4. The cone-shaped coupling element 6 may be designed in two versions, a long version 6.1 and a short version 6.2. In the long version 6.1, the cone-shaped coupling element engages between the jaw teeth 7 and 8. With the long version of the coupling element 6.1, the teeth engaged are 7 and 8.1. Thus, a strong coupling is attained for all switch motions of the manually operated part of a circuit-breaker with this version.

If the short version 6.2 of the cone-shaped coupling element 6 is used, then only the flank of a single jaw tooth 8.2 is adjacent this penetration depth. On the other side of the coupling element 6, however, there is no adjacent jaw tooth 7. In the case of the jaw-shaped coupling element 4 reproduced in the exemplified embodiment, one attains, therefore, for a long cone-shaped coupling element 6.1, a coupling as is desired for auxiliary switches, and for a short cone-shaped coupling element 6.2, a coupling, as is desired for signal circuit controllers, which can be mounted on the circuit-breaker of FIG. 1 without requiring additional coupling elements for the manually operated part.

In the foregoing specification, the invention has been described with reference to a specific exemplary embodiment thereof It will, however, be evident that various modifications and changes may be made thereunto without departing from the broader spirit and scope of the invention as set forth in the appended claims The specification and drawings are, accordingly, to be regarded in an illustrative rather than in a restrictive sense.

What is claimed is:

1. A switching device in a system having a plurality of switching devices, said switching device being coupled to mountable switching, auxiliary switching or signal devices, said switching device comprising a housing, a cylindrical, manually operated part disposed in the housing and having a switching axis, a manually operable selector attached to the cylindrical part, the cylindrical part having two coupling directions determined by movement of said selector, and further comprising a coupling element pair comprising a jaw-shaped coupling element and a cone-shaped coupling element, one of said jaw-shaped coupling element and cone-shaped coupling element being disposed on the cylindrical part in the direction of the switching axis, the jaw-shaped and cone-shaped coupling elements being in engagement, the jaw-shaped coupling element having a jaw tooth, said jaw tooth being in engagement depth only for one coupling direction of the cylindrical part at a shallow penetration by the cone-shaped coupling element into the jaw-shaped coupling element and said jaw tooth being in engagement depth for both coupling directions at a deep penetration by the cone-shaped coupling element into the jaw-shaped coupling element.

2. The switching device recited in claim 1, wherein the jaw-shaped coupling element is arranged on the cylindrical part in the direction of the switching axis on a mounting side, is movable behind a housing slot and engageable with the cone-shaped coupling element in a housing slot on a surface of the housing, the cone-shaped coupling element extending from a device to be attached to the jaw-shaped coupling element.

* * * * *